US009999243B2

(12) United States Patent
Gao et al.

(10) Patent No.: US 9,999,243 B2
(45) Date of Patent: Jun. 19, 2018

(54) EXHAUSTED TOBACCO LOZENGE

(71) Applicant: ALTRIA CLIENT SERVICES LLC, Richmond, VA (US)

(72) Inventors: Feng Gao, Midlothian, VA (US); Diane L. Gee, Chesterfield, VA (US); Phillip M. Hulan, Midlothian, VA (US); Shuzhong Zhuang, Glen Allen, VA (US); William J. Burke, Nashville, TN (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 585 days.

(21) Appl. No.: 14/506,002

(22) Filed: Oct. 3, 2014

(65) Prior Publication Data

US 2015/0096577 A1 Apr. 9, 2015

Related U.S. Application Data

(60) Provisional application No. 61/886,391, filed on Oct. 3, 2013.

(51) Int. Cl.
*A24B 13/00* (2006.01)
*A24B 15/16* (2006.01)

(52) U.S. Cl.
CPC ..... *A24B 13/00* (2013.01); *A24B 15/16* (2013.01)

(58) Field of Classification Search
USPC ..... 131/111, 347, 352, 359, 369, 290
See application file for complete search history.

(56) References Cited

U.S. PATENT DOCUMENTS 2,162,738 A 6/1939 McCoy
3,139,436 A 6/1964 Bicking
(Continued)

FOREIGN PATENT DOCUMENTS

DE 19811167 6/1999
WO 2009/134947 11/2009
WO 2010/044736 4/2010

OTHER PUBLICATIONS

Fitzpatrick et al, "Comparing the caking behaviours of skim milk powder, amorphous maltodextrin and crystalline common salt", Powder Technology, v. 204, No. 1, 2010, pp. 131-137. [online], retrieved from the Internet, [retrieved Mar. 26, 2017], <URL: http://www.sciencedirect.com/science/article/pii/S0032591010003761>.*

(Continued)

*Primary Examiner* — Dennis R Cordray
(74) *Attorney, Agent, or Firm* — Fish & Richardson P.C.

(57) ABSTRACT

An exhausted-tobacco lozenge provided herein includes a body that is partially or wholly receivable in an oral cavity. The body includes a soluble-fiber matrix, exhausted-tobacco fiber, and one or more additives (e.g. nicotine or a derivative thereof) dispersed in the soluble-fiber matrix. In some cases, an exhausted-tobacco lozenge provided herein includes at least 40 weight percent of soluble fiber. In some cases, soluble fiber in exhausted-tobacco lozenge provided herein can include maltodextrin. The exhausted-tobacco lozenge is adapted to release the nicotine or a derivative thereof from the body when the body is received within the oral cavity of an adult tobacco consumer and exposed to saliva. A method of making exhausted-tobacco lozenges provided herein includes forming a molten mixture of at least 40 weight percent soluble fiber, exhausted-tobacco fiber, one or more additives (e.g., nicotine), and less than 15 weight percent water while maintaining a mixture temperature of less than (Continued)

150° C. and portioning the molten mixture into a plurality of exhausted-tobacco lozenges. In some cases, the ingredients can be mixed to form the molten mixture in an extruder.

30 Claims, 5 Drawing Sheets

(56) References Cited

U.S. PATENT DOCUMENTS

| | | | | |
|---|---|---|---|---|
| 3,396,735 | A | 8/1968 | Bethmann et al. | |
| 4,153,063 | A | 5/1979 | Roselius et al. | |
| 4,448,208 | A | 5/1984 | Friedrich et al. | |
| 4,516,590 | A | 5/1985 | Teng | |
| 4,528,993 | A | 7/1985 | Sensabaugh et al. | |
| 4,647,459 | A | 3/1987 | Peters | |
| 4,660,577 | A | 4/1987 | Sensabaugh et al. | |
| 4,848,373 | A | 7/1989 | Lenkey | |
| 4,987,907 | A | 1/1991 | Townend | |
| 5,236,719 | A | 8/1993 | Meyers et al. | |
| 5,284,163 | A | 2/1994 | Knudsen et al. | |
| 5,372,149 | A | 12/1994 | Roth et al. | |
| 5,380,717 | A | 1/1995 | Ohkuma et al. | |
| 5,410,035 | A | 4/1995 | Wakabayashi et al. | |
| 5,487,792 | A | 1/1996 | King et al. | |
| 5,525,351 | A * | 6/1996 | Dam | A23G 3/36 424/434 |
| 5,549,906 | A * | 8/1996 | Santus | A61K 9/0056 424/434 |
| 6,203,842 | B1 | 3/2001 | Reddy | |
| 7,798,151 | B2 | 9/2010 | Krukonis et al. | |
| 9,351,936 | B2 | 5/2016 | Gao | |
| 2004/0118422 | A1 | 6/2004 | Lundin et al. | |
| 2005/0053665 | A1 | 3/2005 | Ek et al. | |
| 2005/0178398 | A1 | 8/2005 | Breslin et al. | |
| 2005/0226925 | A1 | 10/2005 | Singh | |
| 2005/0244521 | A1 | 11/2005 | Strickland et al. | |
| 2006/0171994 | A1 | 8/2006 | Dupinay et al. | |
| 2007/0144544 | A1 | 6/2007 | Cai et al. | |
| 2008/0209586 | A1 | 8/2008 | Nielsen et al. | |
| 2009/0293889 | A1 | 12/2009 | Kumar et al. | |
| 2010/0010101 | A1 | 1/2010 | Cherukuri | |
| 2011/0110880 | A1* | 5/2011 | Chen | A61K 9/0056 424/78.15 |
| 2011/0139164 | A1* | 6/2011 | Mua | A24B 3/14 131/111 |
| 2011/0165253 | A1 | 7/2011 | Roehrich | |
| 2011/0200670 | A1 | 8/2011 | Thakkar | |
| 2012/0053108 | A1 | 3/2012 | Glenn, Jr. et al. | |
| 2012/0060854 | A1* | 3/2012 | Chen | A24B 15/20 131/297 |
| 2013/0071476 | A1 | 3/2013 | Cherukuri | |
| 2013/0186417 | A1 | 7/2013 | Gao et al. | |
| 2013/0186418 | A1 | 7/2013 | Feng et al. | |
| 2013/0260150 | A1 | 8/2013 | Duggins et al. | |
| 2015/0020818 | A1 | 1/2015 | Gao et al. | |

OTHER PUBLICATIONS

Definition of "matrix", The Free Dictionary by Farlex, No Date, [online], retrieved from the Internet, [retrieved Oct. 11, 2017], <URL: http://www.thefreedictionary.com/matrix>.*

International Search Report and Written Opinion in International Application No. PCT/US2014/059148, dated Dec. 12, 2014, 9 pages.

Tso (1999, Chapter 1 in Tobacco, Production, Chemistry and Technology, Davis & Nielsen, eds., Blackwell Publishing, Oxford).

"Particle Size Conversion Table," Sigma-Aldrich, 2003-2004, [online], retreived from the Internet Mar. 29, 2017, <URL: http://www.sigmaaldrich.com/chemistiry/stockroom-reagents/learning-center/technical-libraiy/particle-sizze-conversion.html>.

Avaltroni et al., "Maltodextrin molecular weight distribution influemce on the glass transition tempurature and viscosity in aqueous solutions," Carbohyd Polymers 58:323-334, 2004.

Definition of lozenge, The Free Dictionary, 3 pages, 2002, [online], retrieved from the Internet Mar. 30, 2017, <URL: http://www.thefreedictionaiy.com/lozenge>.

Fitzpatrick et al., "Comparing the caking behaviours of skim milk powder, amorphous maltodextrin and crystalline common salt," Powder Technology 204(1):131-137, 2010.

Gonnissen et al, "Development of Directly Compressible Powders via Co-Spraying," Eur J Pharma Biopharma 67:220, 2007.

International Preliminary Report on Patentability in International Application No. PCT/US2014/059148, dated Apr. 14, 2016, 6 pages.

Patel et al., "Advances in oral transmucosal drug delivery," J Control Release 153(2):106-116, Jul. 30, 2011.

* cited by examiner

EXHAUSTED TOBACCO LOZENGE

CROSS REFERENCE TO RELATED APPLICATIONS

This application claims the benefit of priority under 35 U.S.C. § 119(e) to U.S. Application No. 61/886,391 filed Oct. 3, 2013. The prior application is incorporated herein by reference in its entirety.

TECHNICAL FIELD

This document relates to exhausted-tobacco lozenges and methods for making exhausted-tobacco lozenges. For example, an exhausted-tobacco lozenge can include exhausted-tobacco fiber and nicotine within a soluble-fiber matrix (e.g., maltodextrin).

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

An exhausted-tobacco lozenge provided herein provides a satisfying tactile and/or flavor experience. An exhausted-tobacco lozenge provided herein includes a body that is at least partially receivable in an oral cavity of an adult tobacco consumer. In some cases, an exhausted-tobacco lozenge provided herein includes a body that is wholly receivable in an oral cavity. The body can include a soluble-fiber matrix, exhausted-tobacco fiber, and one or more additives (e.g., nicotine or a derivative thereof) dispersed in the soluble-fiber matrix. In some cases, the body can include unbound nicotine absorbed into exhausted-tobacco fiber. In some cases, an exhausted-tobacco lozenge provided herein includes at least 40 weight percent of soluble fiber. In some cases, soluble fiber in exhausted-tobacco lozenge provided herein can include maltodextrin. An exhausted-tobacco lozenge provided herein can be adapted to release the nicotine or a derivative thereof from the body when the body is received within the oral cavity of an adult tobacco consumer and exposed to saliva. A body of an exhausted-tobacco lozenge provided herein can include a soluble fiber phase forming a matrix around exhausted-tobacco fiber. In some cases, the soluble-fiber matrix of an exhausted-tobacco lozenge provided herein can be amorphous.

A method of making exhausted-tobacco lozenges provided herein includes forming a molten mixture of at least 40 weight percent soluble fiber, exhausted-tobacco fiber, one or more additives (e.g., nicotine or a derivative thereof), and less than 15 weight percent water while maintaining a mixture temperature of less than 150° C. and portioning the molten mixture into a plurality of exhausted-tobacco lozenges. In some cases, the ingredients can be mixed to form the molten mixture in an extruder, flattened into a sheet of a predetermined thickness as it leaves the extruder, and individual exhausted-tobacco lozenges cut from the sheet before the sheet cools below the glass transition temperature range of the molten mixture. Unlike a traditional lozenge, which incorporates sugars or sugar alcohols that are heated to a temperature such that caramelization occurs, methods provided herein include heating the molten mixture to form a solution of nicotine and water (and optionally other ingredients) in the soluble fiber without significant cross-linking. In some cases, additional additives can be added that are dispersed within the soluble fiber matrix, but not in solution with the soluble fiber. Because nicotine degradation can be accelerated when exposed to elevated temperatures over extended periods of time, the temperature of a molten mixture provided herein can be maintained at a temperature of 150° C. or below over a residence time of five to ten minutes or less (for example if an extrusion process is utilized). In some cases, a molten mixture provided herein is heated to a temperature of between 80° C. and 150° C. In some cases, a molten mixture provided herein is heated to a temperature of between 80° C. and 110° C. When cooled below its glass transition temperature, a molten mixture provided herein solidifies into an amorphous, non-porous, soluble fiber matrix containing nicotine and exhausted tobacco. Because the soluble fibers do not become cross-linked, the soluble fibers remain soluble and thus dissolve when placed in an adult tobacco consumer's mouth.

An exhausted-tobacco lozenge body can be rigid and brittle. In some cases, a body provided herein can have a glass transition temperature greater than 37° C. In some cases, a body provided herein can have a glass transition temperature of between 50° C. and 120° C. In some cases, a body provided herein can have a glass transition temperature of between 80° C. and 100° C. An exhausted-tobacco lozenge provided herein can have a coating over the body. In some cases, the body of an exhausted-tobacco lozenge provided herein can be non-porous.

An exhausted-tobacco lozenge body can include at least 40 weight percent of soluble fiber. In some cases, the exhausted-tobacco lozenge body includes at least 50 weight percent of soluble fiber. In some cases, the exhausted-tobacco lozenge body includes at least 60 weight percent of soluble fiber. In some cases, the exhausted-tobacco lozenge body includes at least 70 weight percent of soluble fiber. In some cases, the exhausted-tobacco lozenge body includes at least 75 weight percent of soluble fiber. In some cases, the exhausted-tobacco lozenge body includes at least 80 weight percent of soluble fiber. In some cases, the exhausted-tobacco lozenge body includes at least 85 weight percent of soluble fiber. In some cases, the exhausted-tobacco lozenge body includes at least 90 weight percent of soluble fiber. In some cases, the exhausted-tobacco lozenge body includes at least 95 weight percent of soluble fiber. In some cases, the soluble fiber can include maltodextrin, psyllium, inulin, arabinoxylans, cellulose, and many other plant components such as resistant starch, resistant dextrins, lignin, pectins, beta-glucans, and oligosaccharides or a combination thereof. In some cases, an exhausted-tobacco lozenge body can include at least 40 weight percent maltodextrin. In some cases, the exhausted-tobacco lozenge body includes at least 50 weight percent maltodextrin. In some cases, the exhausted-tobacco lozenge body includes at least 60 weight percent maltodextrin. In some cases, the exhausted-tobacco lozenge body includes at least 70 weight percent maltodextrin. In some cases, the exhausted-tobacco lozenge body includes at least 75 weight percent maltodextrin. In some cases, the exhausted-tobacco lozenge body includes at least 80 weight percent maltodextrin. In some cases, the exhausted-tobacco lozenge body includes at least 85 weight percent maltodextrin. In some cases, the exhausted-tobacco lozenge body includes at least 90 weight percent maltodextrin. In some cases, the exhausted-tobacco lozenge body includes at least 95 weight percent maltodextrin. In some cases, the soluble fiber can include maltodextrin, psyllium, inulin, arabinoxylans, cellulose, and many other plant components such as resistant starch, resistant dextrins, lignin, pectins, beta-glucans, and oligosaccharides or a combination thereof.

In some cases, an exhausted-tobacco lozenge provided herein can include a digestion-resistant soluble fiber (e.g., maltodextrins,) Suitable maltodextrins include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035; 5,380,717. For example, Fibersol®-2 is a maltodextrin of DE 6-10 processed from corn starch using hydrochloric acid and enzymes, which can be used as the soluble fiber in an exhausted-tobacco lozenge provided herein. Fibersol®-2 is partially indigestible because human digestive enzymes are incapable of digesting β 1,2, β 1,3 and β 1,6 glucose bonds. See, e.g., U.S. Pat. No. 6,203,842. Other starch sources such as potato, rice, wheat, barley, peas, beans, lentils, oats, or tapioca can be processed to form digestion-resistant soluble fiber. A digestion resistant soluble fiber includes starch linkages that cannot be hydrolyzed by enzymes of the human digestive tract. Soluble fiber used in an exhausted-tobacco lozenge provided herein can be a soluble fiber generally recognized as safe ("GRAS") by the Food and Drug Administration or another appropriate private, state, or national regulatory agency.

An exhausted-tobacco lozenge provided herein can, in some cases, include up to 15 weight percent water. In some cases, an exhausted-tobacco lozenge provided herein can include between 2 weight percent and 15 weight percent water. In some cases, an exhausted-tobacco lozenge provided herein can include between 3 weight percent and 10 weight percent water. In some cases, an exhausted-tobacco lozenge provided herein can include between 4 weight percent and 7 weight percent water.

Nicotine or derivatives thereof added to an exhausted-tobacco lozenge provided herein can be in any suitable form. In some cases, an exhausted-tobacco lozenge provided herein includes between 0.1 mg and 20 mg nicotine. In some cases, an exhausted-tobacco lozenge provided herein includes between 0.5 mg and 10 mg nicotine. In some cases, an exhausted-tobacco lozenge provided herein includes between 1.0 mg and 3.0 mg nicotine. In some cases, nicotine in an exhausted-tobacco lozenge provided herein includes tobacco-derived nicotine. In some cases, nicotine in an exhausted-tobacco lozenge provided herein includes synthetic nicotine. In some cases, an exhausted-tobacco lozenge provided herein includes less than 40 weight percent of exhausted-tobacco fiber. For example, in some cases, an exhausted-tobacco lozenge provided herein includes between 0.5 weight percent and 40 weight percent of exhausted-tobacco fiber. In some cases, an exhausted-tobacco lozenge provided herein includes between 1.0 weight percent and 10 weight percent of exhausted-tobacco fiber.

An exhausted-tobacco lozenge provided herein can include a sweetener dispersed therein. Suitable sweeteners include saccharine, sucralose, aspartame, acesulfame potassium, and combinations thereof. In some cases, an exhausted-tobacco lozenge provided herein can be substantially free of sugars and sugar alcohols. For example, an exhausted-tobacco lozenge can be substantially free of sugars and sugar alcohols, but include non-nutritive sweeteners. In some cases, an exhausted-tobacco lozenge provided herein can include non-caramelized sugars and/or sugar alcohols in a percentage of no more than 25 weight percent. For example, mannitol and/or sorbitol can be added to reduce the glass transition temperature of a molten mixture provided herein. When included, sugars and sugar alcohols in a molten mixture form a solution with the soluble fiber. Sugars and sugar alcohols can alter the glass transition temperature of a molten mixture provided herein. When cooled below the glass transition temperature, a solution of soluble fiber and sugar alcohols remains an amorphous, non-crosslinked structure.

An exhausted-tobacco lozenge provided herein can include flavorants. The flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, chai, anise, coriander, coffee, mint oils from a species of the genus *Mentha*, cocoa, and combinations thereof. Synthetic flavorants can also be used. In certain cases, a combination of flavorants can be combined to imitate a tobacco flavor. The particular combination of flavorants can be selected from flavorants that are GRAS in a particular country, such as the United States. Flavorants can also be included in the exhausted-tobacco lozenge as encapsulated flavorants.

An exhausted-tobacco lozenge provided herein can include a plasticizer dispersed in the soluble-fiber matrix. For example, the plasticizer can be propylene glycol, triacetin, glycerin, vegetable oil, partially hydrogenated oil, triglycerides, triacetin, or a combination thereof.

A body of an exhausted-tobacco lozenge provided herein can have a variety of different shapes, some of which include disk, shield, heart, rectangle, and square. In some cases, a body of an exhausted-tobacco lozenge provided herein can have rounded corners. In some cases, the body of the exhausted-tobacco lozenge can be spherical. According to certain cases, the body can have a length or width of between 1 mm and 25 mm and a thickness of between 1 mm and 25 mm. In some cases, the body can have a length or width of between 5 mm and 15 mm and a thickness of between 2 mm and 5 mm. In some cases, an exhausted-tobacco lozenge provided herein can include a colorant. For example, a body of an exhausted-tobacco lozenge provided herein can include titanium dioxide, which can provide the body with a white color. In some cases, a coating on the body can include a colorant.

A method of forming exhausted-tobacco lozenges can include forming a molten mixture of at least 40 weight percent soluble fiber, exhausted-tobacco fiber, nicotine, and less than 15 weight percent water, while maintaining a mixture temperature of less than 150° C. In some cases, the molten mixture includes at less than 13 weight percent, less than 10 weight percent, less than 8 weight percent, less than 7 weight percent, less than 6 weight percent, or less than 5 weight percent water. In some cases, the molten mixture includes at least 3 weight percent, at least 4 weight percent, at least 6 weight percent, or at least 7 weight percent water. In addition to nicotine, water, and soluble fiber (e.g., maltodextrin), a molten mixture provided herein can include one or more additives selected from colorants, sweeteners, flavorants, plasticizers, antioxidants, and combinations thereof. In some cases, the molten mixture is substantially free of cellulose fiber, tobacco plant tissue, sugar, and/or sugar alcohols.

In some cases, the molten mixture provided herein is formed in an extruder. The extruder can be a multi-staged extruder having different sections that are heated to different temperatures and/or have different ingredients introduced. In some cases, an extruder provided herein can include multiple stages and can be used in a method provided herein in a process where the maximum temperature in any stage is no more than 150° C. (e.g., no more than 120° C., no more than 110° C., or no more than 105° C.). In some cases, the molten mixture can be heated to a maximum temperature of greater than the molten mixture's Tg and less than 150° C.

Portioning the molten mixture provided herein can be accomplished using any suitable method. In some cases, the molten mixture can be formed into a sheet of a predetermined thickness as it comes out of the extruder and individual exhausted-tobacco lozenges cut from the sheet with a stamping die. A method provided herein can further include cooling exhausted-tobacco lozenges and packaging exhausted-tobacco lozenges.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

The exhausted-tobacco lozenges described herein include exhausted-tobacco fiber and nicotine or a derivative thereof in a soluble-fiber matrix. Nicotine or a derivative thereof can be dispersed in the soluble-fiber matrix such that the nicotine or derivative thereof is released from the exhausted-tobacco lozenge as it dissolves when the exhausted-tobacco lozenge is received within the oral cavity and exposed to saliva. The exhausted-tobacco lozenges described herein can provide a favorable additive release profile and tactile experience. In some cases, an exhausted-tobacco lozenge provided herein includes unbound nicotine in solution with soluble fiber of the matrix.

In addition to nicotine and/or derivatives thereof, one or more additional additives can be included in an exhausted-tobacco lozenge provided herein and adapted to be released from the exhausted-tobacco lozenge when the exhausted-tobacco lozenge is placed in an oral cavity. In some cases, an exhausted-tobacco lozenge provided herein can include a combination of nicotine, sweeteners, and flavorants to mimic the flavor profile and tactile experience of certain tobacco products.

An exhausted-tobacco lozenge provided herein can take up to 1 hour to dissolve when placed in an adult tobacco consumer's mouth. In some cases, an exhausted-tobacco lozenge provided herein can take between 1 minute and 30 minutes to dissolve when placed in an adult tobacco consumer's mouth if the adult tobacco consumer does not masticate the exhausted-tobacco lozenge. In some cases, an exhausted-tobacco lozenge provided herein can take between 2 minutes and 15 minutes to dissolve when placed in an adult tobacco consumer's mouth if the adult tobacco consumer does not masticate the exhausted-tobacco lozenge.

Exhausted-tobacco lozenges provided herein can include exhausted-tobacco fibers having an average fiber size of less than 200 micrometers. In particular cases, exhausted-tobacco fibers in an exhausted-tobacco lozenge provided herein have sizes between 25 and 125 micrometers.

In addition to nicotine, exhausted-tobacco fiber, sweeteners, and flavorants, the exhausted-tobacco lozenge can also include fillers, plasticizers, antioxidants, and/or processing aids. Fillers can also be included in the soluble-fiber matrix to alter the texture or pliability of the exhausted-tobacco lozenge. The soluble-fiber matrix can also include plasticizers (e.g., propylene glycol), which can increase the softness of an exhausted-tobacco lozenge provided herein. Antioxidants can be used to preserve nicotine in the exhausted-tobacco lozenge. Processing aids can also be present in the exhausted-tobacco lozenge and be used to facilitate shaping processes.

Exhausted-Tobacco Lozenge Shapes and Packaging

Figure 1:
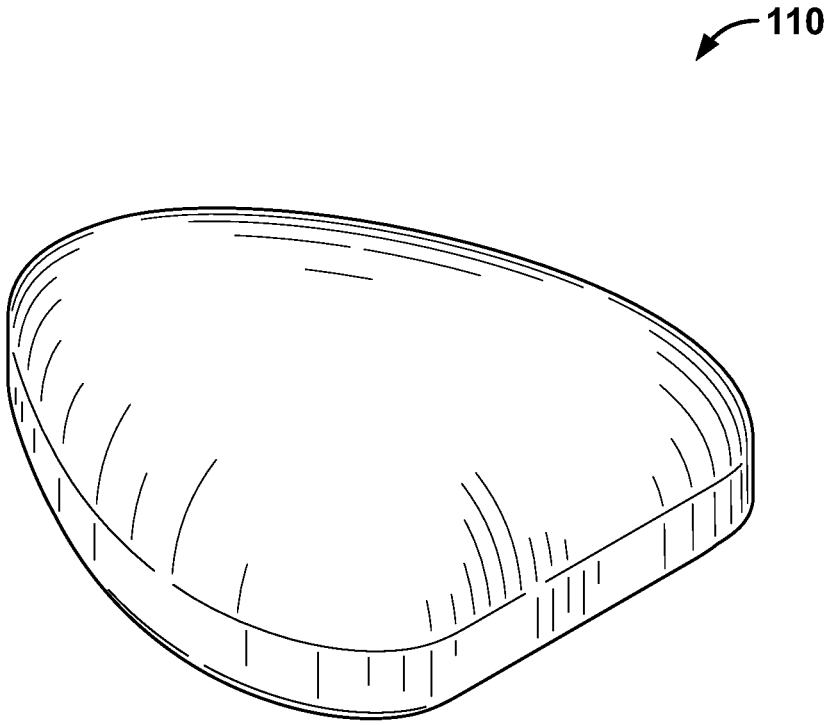
FIG. 1 is a perspective view of an exemplary exhausted-tobacco lozenge provided herein.

FIG. 1 depicts an example of an exhausted-tobacco lozenge 110. The exhausted-tobacco lozenge 110 has a rounded shield shape. For example, exhausted-tobacco lozenge 110 can have a diameter of about 12 mm and a thickness of about 2.5 mm.

Figure 1A:
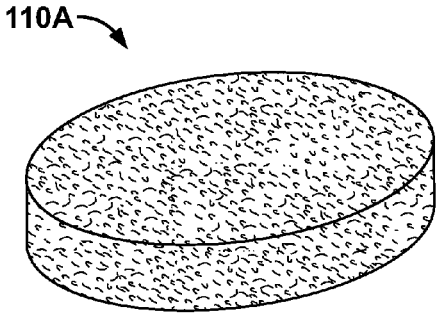
FIGS. 1A-1O illustrates various additional exemplary shapes of exhausted-tobacco lozenges provided herein.
Figure 1B:
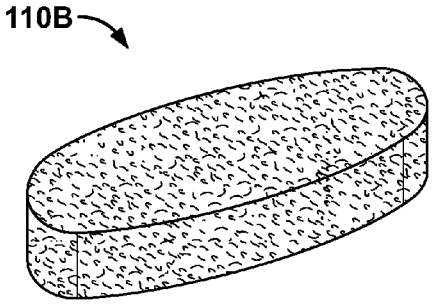
Figure 1C:
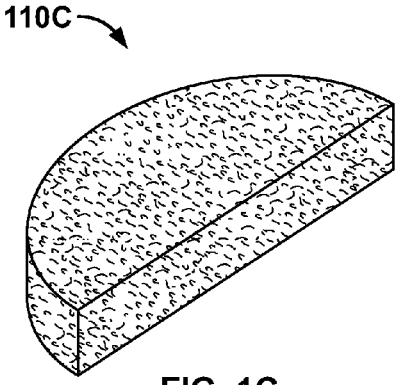
Figure 1D:
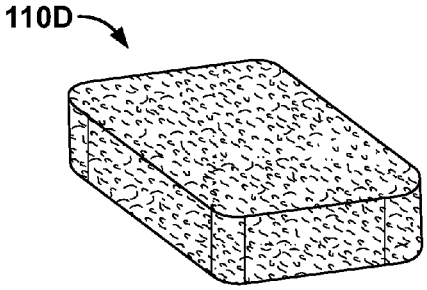
Figure 1E:
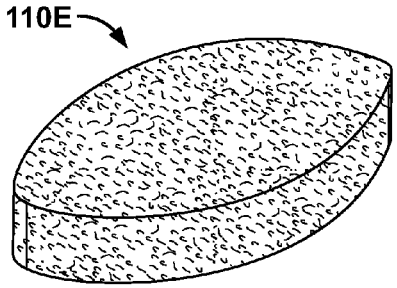
Figure 1F:
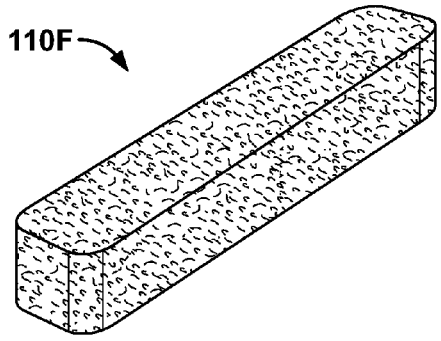
Figure 1G:
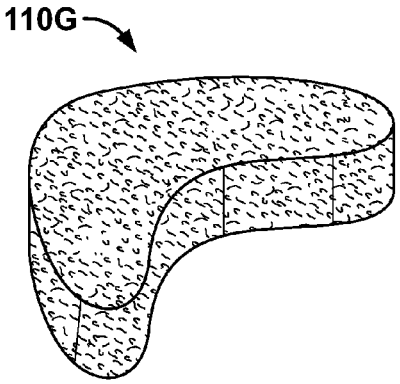
Figure 1H:
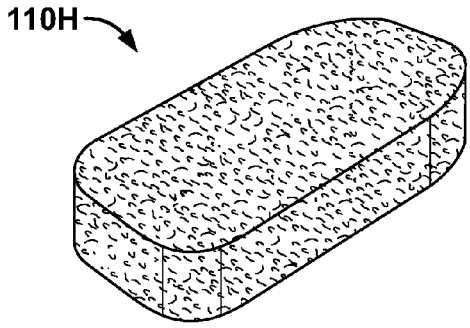
Figure 1I:
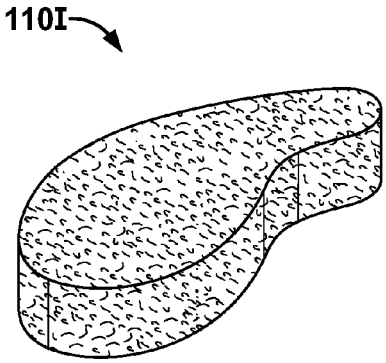
Figure 1J:
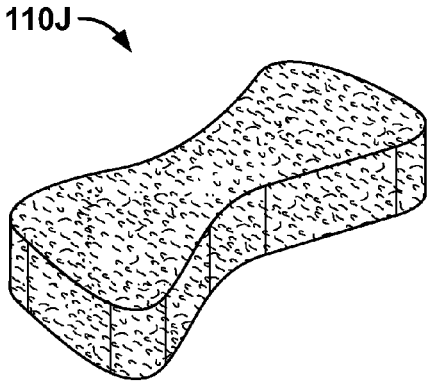
Figure 1K:
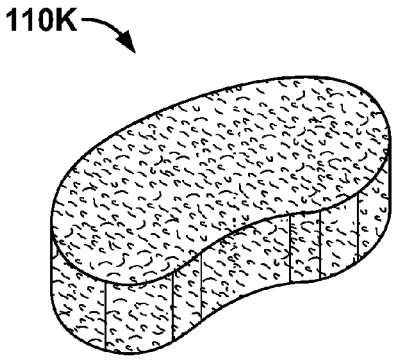
Figure 1L:
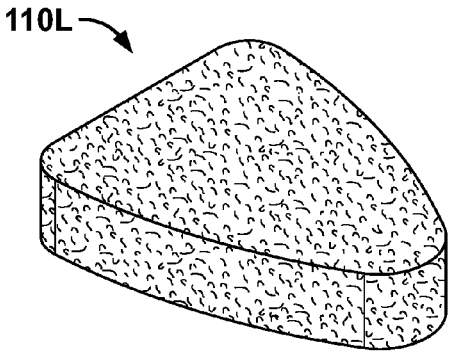
Figure 1M:
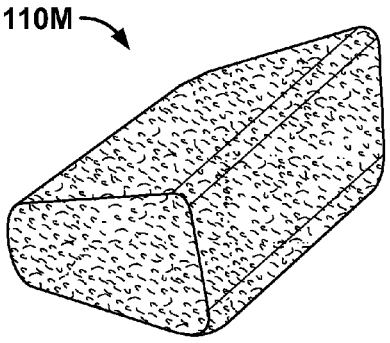
Figure 1N:
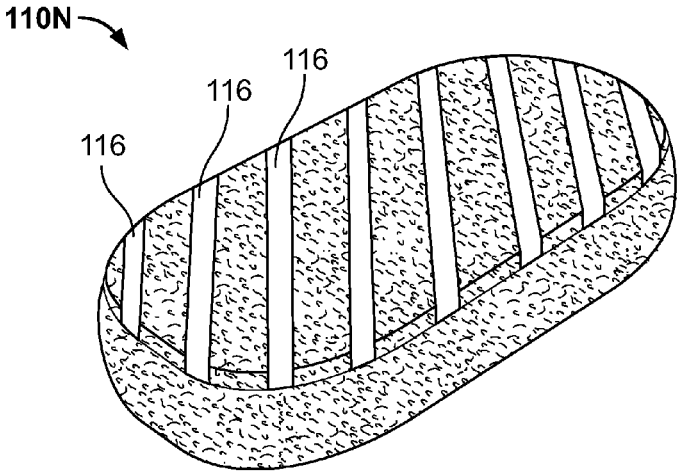

Referring now to FIGS. 1A-1N, exhausted-tobacco lozenges provided herein can be molded into any desired shape. For example, referring to FIGS. 1A-1L, exhausted-tobacco lozenges 110A-L can be formed in shapes that promotes improved positioning in the oral cavity, improved packaging characteristics, or both. In some circumstances, exhausted-tobacco lozenges 110A-L can be configured to be: (A) an elliptical-shaped exhausted-tobacco lozenge 110A; (B) an elongated elliptical-shaped exhausted-tobacco lozenge 110B; (C) semi-circular exhausted-tobacco lozenge 110C; (D) square or rectangular-shaped exhausted-tobacco lozenge 110D; (E) football-shaped exhausted-tobacco lozenge 110E; (F) elongated rectangular-shaped exhausted-tobacco lozenge 110F; (G) boomerang-shaped exhausted-tobacco lozenge 110G; (H) rounded-edge rectangular-shaped exhausted-tobacco lozenge 110H; (I) teardrop- or comma-shaped exhausted-tobacco lozenge 110I; (J) bowtie-shaped exhausted-tobacco lozenge 110J; (K) peanut-shaped exhausted-tobacco lozenge 110K; and (L) flat shield-shaped exhausted-tobacco lozenge. Alternatively, the exhausted-tobacco lozenge can have different thicknesses or dimensionality, such that a beveled article (e.g., a wedge) is produced (see, for example, product 110M depicted in FIG. 1M) or a hemi-spherical shape is produced.

In addition or in the alternative to flavorants being included within the soluble-fiber matrix, flavorants can be included on an exterior of the exhausted-tobacco lozenge 110. For example, referring to FIG. 1N, for example, some embodiments of an exhausted-tobacco lozenge 110N can be equipped with flavor strips 116.

Figure 1O:
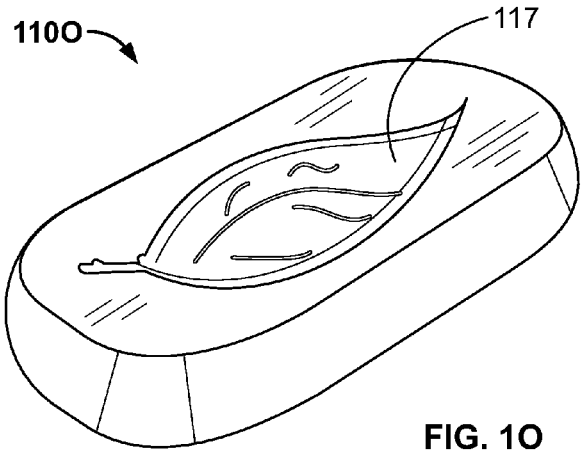

Referring to FIG. 1O, particular embodiments of the exhausted-tobacco lozenge 110 can be embossed or stamped with a design (e.g., a logo, an image, or the like). For example, the exhausted-tobacco lozenge 110O can be embossed or stamped with any type of design 117 including, but not limited to, a trademark, a product name, or any type of image. The design 117 can be formed directly into the exhausted-tobacco lozenge, arranged along the exterior of the product 110O. The design 117 can also be embossed or stamped into those embodiments with a dissolvable film 116 applied thereto.

In some cases, the exhausted-tobacco lozenge 110 or lozenges 110A-O can be wrapped or coated in an edible or dissolvable film, which may be opaque, substantially transparent, or translucent. The dissolvable film can readily dissipate when the exhausted-tobacco lozenge 110 is placed in an oral cavity. In some cases, the exhausted-tobacco lozenge 110 can be coated with a mouth-stable material. Exemplary coating materials include Beeswax, gelatin, acetylated monoglyceride, starch (e.g., native potato starch, high amylose starch, hydroxypropylated potato starch), Zein, Shellac, ethyl cellulose, methylcellulose, hydroxypropyl methylcellulose, carboxymethyl cellulose, and combinations thereof. For example, a coating can include a combination of gelatin and methylcellulose. In some cases, a coating material can include a plasticizer. In some case, a coating can include a colorant, a flavorant, and/or a one or more of the additives discussed above. For example, a coating can include nicotine to provide a user with readily available nicotine. In some cases, the body of an exhausted-tobacco lozenge provided herein can have surfaces roughened to improve the adherence of a coating. In some cases, a coating can provide a glossy or semi-glossy appearance, a smooth surface, and/or an appealing visual aesthetic (e.g., a nice color). In some cases, the coating (e.g., a Beeswax, Zein, acetylated monoglyceride, and/or hydroxypropylated potato starch coating) can provide a soft mouth feel. In some cases, the coating (e.g., a methylcellulose, hydroxypropyl methylcellulose, carboxymethyl cellulose, ethyl cellulose, and/or gelatin coating) can provide a hard outer coating.

One or more exhausted-tobacco lozenges 110 can be packaged in a variety of conventional and non-conventional manners. For example, a plurality of exhausted-tobacco lozenges 110 can be packaged in a container having a lid. In some cases, a plurality of exhausted-tobacco lozenges 110 can be stacked and packaged in a paper, plastic, and/or aluminum foil tube. The packaging can have a child-resistant lid.

Exhausted-Tobacco Lozenge Properties

The exhausted-tobacco lozenge 110 can provide a favorable tactile experience (e.g., mouth feel). The exhausted-tobacco lozenge 110 can also retain its shape during processing, shipping, handling, and optionally while placed in the mouth. In some cases, the exhausted-tobacco lozenge 110 can be rigid. In some cases, an exhausted-tobacco lozenge 110 can be brittle such that an adult tobacco consumer can crunch or masticate the exhausted-tobacco lozenge 110 in the adult tobacco consumer's mouth. An exhausted-tobacco lozenge 110 provided herein can be non-porous. Manipulation of an exhausted-tobacco lozenge 110 provided herein to increase the exposure of surfaces to saliva can accelerate a dissolution rate.

An exhausted-tobacco lozenge 110 provided herein can have a glass transition temperature (Tg) that is in the range of 50° C. to 120° C. (i.e., about 122° F. to about 248° F.), depending on formulations (e.g. soluble fiber type and weight percentage, water content, total flavor weight percentage, etc.) and processing conditions used to form the exhausted-tobacco lozenge 110. The Tg can impact the preferred operating temperature used to form a solution of the soluble fiber, nicotine, and other ingredients. By changing the soluble fiber weight percentage and type, the Tg range can be altered. In some cases, when an exhausted-tobacco lozenge provided herein is placed in an adult tobacco consumer's mouth, the exhausted-tobacco lozenge is not soft, but remains as an amorphous glassy state, as the adult tobacco consumer's body temperature is below the glass transition temperature range of the product. Exhausted-tobacco lozenges provided herein can remain in a glassy state throughout the duration of its shelf life (e.g., at least 2 months, at least 6 months, at least 1 year, or at least 2 years). The Tg temperature can also impact a sensorial experience provided by an exhausted-tobacco lozenge provided herein. For example, a glass transition temperature above body temperature can impede an exhausted-tobacco lozenge from becoming sticky when placed in the adult tobacco consumers' mouth.

An exhausted-tobacco lozenge 110 provided herein can have any desirable color. In some cases, an exhausted-tobacco lozenge 110 provided herein can be translucent and have an off-white color. In some cases, a colorant can be included to provide a desired visual appearance. In some cases, natural and artificial colorant can be added to a soluble-fiber matrix of an exhausted-tobacco lozenge 110. In some cases, colorants can make a body of an exhausted-tobacco lozenge opaque. For example, titanium dioxide can be added to a soluble-fiber matrix to produce an opaque white exhausted-tobacco lozenge. Encapsulated flavors can be added during the extrusion process to create speckles, patterns or dots within the exhausted-tobacco lozenge or on a surface of an exhausted-tobacco lozenge 110. In some cases, a coating applied to a body of an exhausted-tobacco lozenge can provide a desirable color.

When an exhausted-tobacco lozenge provided herein is placed in an adult tobacco consumer's mouth, an exhausted-tobacco lozenge can remain as an amorphous glassy state, as the adult tobacco consumer's body temperature is below the glass transition temperature range of the exhausted-tobacco lozenge provided herein. An exhausted-tobacco lozenge provided herein can be designed to remain in a glassy state throughout the duration of its shelf life for the product. In some cases, an exhausted-tobacco lozenge provided herein can have a Tg that impacts the sensorial experience. For example, an exhausted-tobacco lozenge provided herein having a Tg range greater than body temperature and remain non-sticky when placed in an adult tobacco consumer's mouth.

Soluble Fibers

Soluble fiber dissolves in ambient water. Insoluble fiber does not dissolve in ambient water. Soluble fibers can attract water and form a gel. Not only are many soluble fibers safe for consumption, but some soluble fibers are used as a dietary supplement. As a dietary supplement, soluble fiber can slow down digestion and delay the emptying of a stomach. Instead of using soluble fiber as a mere additive, however, exhausted-tobacco lozenges provided herein include a matrix of soluble fiber, which can dissolve to provide access to nicotine (and optionally other additives) included in the soluble-fiber matrix.

Any suitable soluble fiber or combination of soluble fibers can be used to form a soluble-fiber matrix provided herein. Suitable soluble fibers include maltodextrin, psyllium, pectin, guar gum, gum arabic, inulin, arabinoxylans, cellulose, and many other plant components such as resistant starch, resistant dextrins, lignin, pectins, beta-glucans, and oligosaccharides or a combination thereof. In some cases, an exhausted-tobacco lozenge provided herein can include a digestion-resistant soluble fiber. A digestion resistant soluble fiber can include starch linkages that remain undigested by enzymes of the human digestive tract. In some cases, an exhausted-tobacco lozenge provided herein can include a digestion-resistant maltodextrin. In some cases, a digestion-resistant maltodextrin can be derived from maze. Suitable maltodextrins can include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035; 5,380,717, which are hereby incorporated by reference. For example, Fibersol®-2 is a maltodextrin of DE 6-10 processed from corn starch using hydrochloric acid and enzymes, which can be used as the soluble fiber in a exhausted tobacco lozenge provided herein. Fibersol®-2 is partially indigestible because human digestive enzymes are incapable of digesting β 1,2, β 1,3 and β 1,6 glucose bonds. See, e.g., U.S. Pat. No. 6,203,842. Other starch sources such as potato, rice, wheat, barley, peas, beans, lentils, oats, or tapioca can be processed to form digestion-resistant soluble fiber. A digestion resistant soluble fiber includes starch linkages that cannot be hydrolyzed by enzymes of the human digestive tract. In some cases, suitable soluble fibers include Pinefibre, Pinefibre C, Dexflow and Pineflow as discussed in U.S. Pat. No. 5,236,719, which is hereby incorporated by reference. Soluble fiber used in a exhausted tobacco lozenge provided herein can be designated as GRAS by the Food and Drug Administration or another appropriate private, state, or national regulatory agency.

An exhausted-tobacco lozenge body can include at least 40 weight percent of soluble fiber, at least 50 weight percent of soluble fiber, at least 60 weight percent of soluble, at least 70 weight percent of soluble fiber, at least 75 weight percent of soluble fiber, at least 80 weight percent of soluble fiber, at least 85 weight percent of soluble fiber, at least 90 weight percent of soluble fiber, or at least 95 weight percent of soluble fiber. In some cases, an exhausted-tobacco lozenge body can include at least 40 weight percent maltodextrin, at least 50 weight percent maltodextrin, at least 60 weight percent maltodextrin, at least 70 weight percent maltodextrin, at least 75 weight percent maltodextrin, at least 80 weight percent maltodextrin, at least 85 weight percent maltodextrin, at least 90 weight percent maltodextrin, or at least 95 weight percent maltodextrin. In some cases, an exhausted-tobacco lozenge body can include less than 90 weight percent maltodextrin, less than 85 weight percent maltodextrin, or less than 80 weight percent maltodextrin. In some cases, an exhausted-tobacco lozenge body can include at least 40 weight percent digestion-resistant maltodextrin, at least 50 weight percent digestion-resistant maltodextrin, at least 60 weight percent digestion-resistant maltodextrin, at least 70 weight percent digestion-resistant maltodextrin, at least 75 weight percent digestion-resistant maltodextrin, at least 80 weight percent digestion-resistant maltodextrin, at least 85 weight percent digestion-resistant maltodextrin, at least 90 weight percent digestion-resistant maltodextrin, or at least 95 weight percent digestion-resistant maltodextrin.

Exhausted-Tobacco Fibers

An exhausted-tobacco lozenge provided herein can include exhausted-tobacco fibers within a soluble-fiber matrix. As will be discussed below, the exhausted-tobacco fibers can be mixed with the soluble fiber prior to or during an extrusion process. Exhausted-tobacco fibers can provide passages in a soluble-fiber matrix, which can permit certain additives within a soluble-fiber matrix to be released into an oral cavity when an exhausted-tobacco lozenge provided herein is received in an oral cavity and exposed to saliva. The additives can be absorbed in fiber-polymer matrix and/or form pockets within a soluble-fiber matrix, which can be accessed via the exhausted-tobacco fibers or as the soluble-fiber matrix dissolves. An exhausted-tobacco lozenge provided herein can also include channels and pores formed in the exhausted-tobacco fibers. The water-soluble additives can be wicked by the exhausted-tobacco fibers.

Exhausted-tobacco fibers are derived from tobacco plant tissue. Exemplary species of tobacco include *N. rustica, N. tabacum, N. tomentosiformis*, and *N. sylvestris*. The exhausted-tobacco fibers can be obtained from any part of a tobacco plant, including the stems, leaves, or roots of a tobacco plant. The tobacco plant tissue is treated to remove at least 10 weight percent of the tobacco's soluble components, which can include alkaloids (e.g., nicotine), nitrosamines. In some cases, the exhausted tobacco plant tissue can be treated to remove at least 25%, 40%, 50%, 60%, 70%, 75%, 80%, 85%, 90%, or 95%, or 99% of the tobacco's soluble components. In some cases, the exhausted-tobacco fibers include less than 75%, less than 50%, less than 25%, less than 10%, less than 5%, or less than 1% of the nicotine normally found in tobacco plant tissue. In some cases, the exhausted-tobacco fibers include less than 75%, less than 50%, less than 25%, less than 10%, less than 5%, or less than 1% of the nitrosamines normally found in tobacco plant tissue. The treatment can also remove other soluble components of the tobacco plant tissue. In some cases, the exhausted tobacco can be obtained by washing tobacco plant tissue (e.g., tobacco stems) with slightly basic buffer solution. In some cases, exhausted tobacco can be obtained by treating the tobacco with supercritical fluids. For example, the exhausted tobacco can be obtained by the processes described in U.S. Pat. No. 7,798,151, which is hereby incorporated by reference.

Before or after treatment to remove at least some of the tobacco's soluble components, tobacco plant tissue can be treated by one or more conventional tobacco treating techniques, which may impact the flavor, aroma, color, and/or texture of the tobacco plant tissue. Some conventional tobacco treating techniques include fermentation, heat treating, enzyme treating, expanding, and curing. Exhausted-tobacco fibers can have the aroma of tobacco without contributing significantly to the components released by the exhausted tobacco oral product. Desired quantities of particular components can be added the exhausted tobacco oral product.

The exhausted-tobacco fibers can, in some cases, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference.

Exhausted-tobacco fibers can be processed to a desired size. In certain embodiments, the cellulosic fiber can be processed to have an average fiber size of less than 200 micrometers. In particular embodiments, the fibers are between 25 and 125 micrometers. In other embodiments, the fibers are processed to have a size of 75 micrometers or less. In still other embodiments, the exhausted-tobacco fibers can be cut or shredded into widths of about 10 cuts/inch up to about 110 cuts/inch and lengths of about 0.1 inches up to about 1 inch. Exhausted-tobacco fibers can also be cut twice to have a range of particle sizes such that about 70% of the exhausted-tobacco fibers fall between the mesh sizes of 20 mesh and 80 mesh. Additives can be absorbed in exhausted-tobacco fibers. In some cases, exhausted-tobacco fibers are hydrophilic such that water-soluble additives can be wicked by the exhausted-tobacco fibers.

Exhausted-tobacco fibers can have a total oven volatiles content of about 0.5% or greater; 10% by weight or greater; about 20% by weight or greater; about 40% by weight or greater; about 0.5% by weight to about 10% by weight; about 5% to 20% by weight; about 15% by weight to about 25% by weight; about 20% by weight to about 30% by weight; about 30% by weight to about 50% by weight; about 45% by weight to about 65% by weight; or about 50% by weight to about 60% by weight. As used herein, "oven volatiles" are determined by calculating the percentage of weight loss for a sample after drying the sample in a pre-warmed forced draft oven at 110° C. for 3.25 hours.

Exhausted-tobacco fibers can also be combined with non-tobacco cellulosic fibers. Suitable sources for non-tobacco cellulosic fibers include wood pulp, cotton, sugar beets, bran, citrus pulp fiber, switch grass and other grasses, *Salix* (willow), tea, and *Populus* (poplar). In some cases, the non-tobacco cellulosic fibers can be plant tissue comprising various natural flavors, sweeteners, or active ingredients.

Additives

A variety of additives other than exhausted-tobacco fiber can be included in an exhausted-tobacco lozenge provided herein. The additives can include alkaloids (e.g., nicotine), minerals, vitamins, dietary supplements, nutraceuticals, energizing agents, soothing agents, coloring agents, amino acids, chemsthetic agent, antioxidants, food grade emulsifiers, pH modifiers, botanicals (e.g., green tea), teeth whitening (e.g., SHMP), therapeutic agents, sweeteners, flavorants, and combinations thereof. In some cases, the additives can further include one or more non-nutritive sweeteners, one or more antioxidants, and one or more flavorants. With certain combinations of nicotine, sweeteners, and flavorants, an exhausted-tobacco lozenge provided herein may provide a flavor profile and tactile experience similar to certain tobacco products.

Nicotine

Nicotine within an exhausted-tobacco lozenge provided herein can be tobacco-derived nicotine, synthetic nicotine, or a combination thereof. In some cases, the nicotine can be liquid nicotine. Liquid nicotine can be purchased from commercial sources, whether tobacco-derived or synthetic. In some cases, an exhausted-tobacco lozenge provided herein includes between 0.1 mg and 6.0 mg of nicotine. In some cases, an exhausted-tobacco lozenge provided herein includes between 1.0 mg and 3.0 mg of nicotine.

Tobacco-derived nicotine can include one or more other tobacco organoleptic components other than nicotine. The tobacco-derived nicotine can be extracted from raw (e.g., green leaf) tobacco and/or processed tobacco. Processed tobaccos can include fermented and unfermented tobaccos, dark air-cured, dark fire cured, burley, flue cured, and cigar filler or wrapper, as well as the products from the whole leaf stemming operation. The tobacco can also be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. By processing the tobacco prior to extracting nicotine and other organoleptic components, the tobacco-derived nicotine may include ingredients that provide a favorable experience. The tobacco-derived nicotine can be obtained by mixing cured tobacco or cured and fermented tobacco with water or another solvent (e.g., ethanol) followed by removing the insoluble tobacco material. The tobacco extract may be further concentrated or purified. In some cases, select tobacco constituents can be removed. Nicotine can also be extracted from tobacco in the methods described in the following patents: U.S. Pat. Nos. 2,162,738; 3,139,436; 3,396,735; 4,153,063; 4,448,208; and 5,487,792.

The nicotine can also be purchased from commercial sources, whether tobacco-derived or synthetic. In some cases, an exhausted-tobacco lozenge provided herein can include a derivative of nicotine (e.g., a salt of nicotine).

Liquid nicotine can be pure, substantially pure, or diluted prior to mixing it with the soluble fiber. A diluting step is optional. In some cases, liquid nicotine is diluted to a concentration of between 1 weight percent and 75 weight percent prior to mixing the liquid nicotine with the soluble fiber. In some cases, liquid nicotine is diluted to a concentration of between 2 weight percent and 50 weight percent prior to mixing the liquid nicotine with the soluble fiber. In some cases, liquid nicotine is diluted to a concentration of between 5 weight percent and 25 weight percent prior to mixing the liquid nicotine with the soluble fiber. For example, liquid nicotine can be diluted to a concentration of about 10 weight percent prior to mixing the liquid nicotine with the soluble fiber.

Antioxidants

An exhausted-tobacco lozenge 110 provided herein can include one or more antioxidants. Antioxidants can result in a significant reduction in the conversion of nicotine into nicotine-N-oxide when compared to nicotine products without antioxidants. In some cases, an exhausted-tobacco lozenge provided herein can include 0.01 and 5.00 weight percent antioxidant, between 0.05 and 1.0 weight percent antioxidant, between 0.10 and 0.75 weigh percent antioxidant, or between 0.15 and 0.5 weight percent antioxidant. Suitable examples of antioxidants include ascorbyl palmitate (a vitamin C ester), BHT, ascorbic acid (Vitamin C), and sodium ascorbate (Vitamin C salt). In some cases, monosterol citrate, tocopherols, propyl gallate, tertiary butylhydroquinone (TBHQ), butylated hydroxyanisole (BHA), Vitamin E, or a derivative thereof can be used as the antioxidant. For example, ascorbyl palmitate can be the antioxidant in the formulations listed in Table I. Antioxidants can be incorporated into the soluble-fiber matrix (e.g., maltodextrin) during a mixing process (e.g., added to an extruder mixing the ingredients).

Sweeteners

A variety of synthetic and/or natural sweeteners can be used as additives in an exhausted-tobacco lozenge 110 provided herein. Suitable natural sweeteners include sugars, for example, monosaccharides, disaccharides, and/or polysaccharide sugars, and/or mixtures of two or more sugars. In some cases, an exhausted-tobacco lozenge 110 provided herein includes one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. An exhausted-tobacco lozenge provided herein an also include non-nutritive sweeteners. Suitable non-nutritive sweeteners include: stevia, saccharin; aspartame; sucralose; or acesulfame potassium.

Flavorants

The exhausted-tobacco lozenge provided herein can optionally include one or more flavorants. The flavorants can be natural or artificial. For example, suitable flavorants include wintergreen, cherry and berry type flavorants, various liqueurs and liquors (such as Dramboui, bourbon, scotch, and whiskey) spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, coriander, coffee, liquorish, and mint oils from a species of the genus *Mentha*, and encapsulated flavors. Mint oils useful in particular embodiments of an exhausted-tobacco lozenge 110 provided herein include spearmint and peppermint. Synthetic flavorants can also be used. In some cases, a combination of flavorants can be combined to imitate a tobacco flavor. The particular combination of flavorants can be selected from flavorants that are GRAS in a particular country, such as the United States. Flavorants can also be included in the exhausted-tobacco lozenge as encapsulated flavorants.

In some cases, the flavorants in an exhausted-tobacco lozenge provided herein are limited to less than 20 weight percent in sum. In some cases, the flavorants in the exhausted-tobacco lozenge 110 are limited to be less than 10 weight percent in sum. For example, certain flavorants can be included in the exhausted-tobacco lozenge 110 in amounts of about 1 weight percent to 5 weight percent.

Other Additives

An exhausted-tobacco lozenge provided herein may optionally include other additives. For example, these additives can include non-nicotine alkaloids, dietary minerals, vitamins, dietary supplements, therapeutic agents, and fillers. For example, suitable vitamins include Vitamins A, B1, B2, B6, C, D2, D3, E, F, and K. For example, an exhausted-tobacco lozenge 110 provided herein can include C-vitamins. Suitable dietary minerals include calcium (as carbonate, citrate, etc.) or magnesium (as oxide, etc.), chromium (usually as picolinate), and iron (as bis-glycinate). One or more dietary minerals could be included in an exhausted-tobacco lozenge with or without the use of other additives. Other dietary supplements and/or therapeutic agents can also be included as additives.

An exhausted-tobacco lozenge provided herein can also include fillers such as starch, dicalcium phosphate, lactose, sorbitol, mannitol, and microcrystalline cellulose, calcium carbonate, dicalcium phosphate, calcium sulfate, clays, silica, glass particles, sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), stabilizers (e.g., ascorbic acid and monosterol citrate, BHT, or BHA), disintegrating agents (e.g., starch, sodium starch glycolate, cross caramellose, crosslinked PVP), pH stabilizers, or preservatives. In some cases, the amount of filler in the exhausted-tobacco lozenge 110 is limited to less than 10 weight percent in sum. In some cases, the amount of filler in the exhausted-tobacco lozenge 110 is limited to be less than 5 weight percent in sum. In some cases, the fillers are mouth stable. In some cases, the fillers can dissolve or disintegrate during use and thus result in an exhausted-tobacco lozenge that becomes more pliable during use.

Plasticizers

An exhausted-tobacco lozenge 110 provided herein can also include one or more plasticizers. Plasticizers can soften the final exhausted-tobacco lozenge and thus increase its flexibility. Suitable plasticizers include propylene glycol, triacetin, glycerin, vegetable oil, and medium chain triglycerides. In some cases, the plasticizer can include phthalates. Esters of polycarboxylic acids with linear or branched aliphatic alcohols of moderate chain length can also be used as plasticizers. Moreover, plasticizers can facilitate the extrusion processes described below. In some cases, an exhausted-tobacco lozenge 110 provided herein can include up to 20 weight percent plasticizer. In some cases, the exhausted-tobacco lozenge 110 includes between 0.5 and 40 weight percent plasticizer, an exhausted-tobacco lozenge 110 provided herein can include between 1 and 8 weight percent plasticizer, or between 2 and 4 weight percent plasticizer.

Production and Example

The exhausted-tobacco lozenge 110 can be produced by forming a molten mixture of soluble fiber, water, exhausted-tobacco fiber, and one or more additives (e.g., nicotine) under controlled heating conditions such that a solution of soluble fiber, water, and optionally one or more additives (e.g., nicotine) is formed without degrading the soluble fiber or the one or more additives. In some cases, a temperature of the molten mixture is maintained at a temperature below 150° C. for a period of time (e.g., a residence time of five to ten minutes or less). The molten mixture is then portioned into individual exhausted-tobacco lozenges. Unlike many traditional lozenges, sugar and sugar alcohols are not required to obtain a firm smooth-dissolving texture in processes provided herein. Traditional lozenges can rely on the crosslinking of sugars or sugar alcohols due to caramelization caused by heating to caramelization temperatures. Caramelization temperatures, however, can degrade certain additives, such as nicotine. A soluble-fiber matrix, however, can provide an exhausted-tobacco lozenge provided herein with a suitable dissolution time when placed in an adult tobacco consumer's mouth.

Figure 2:
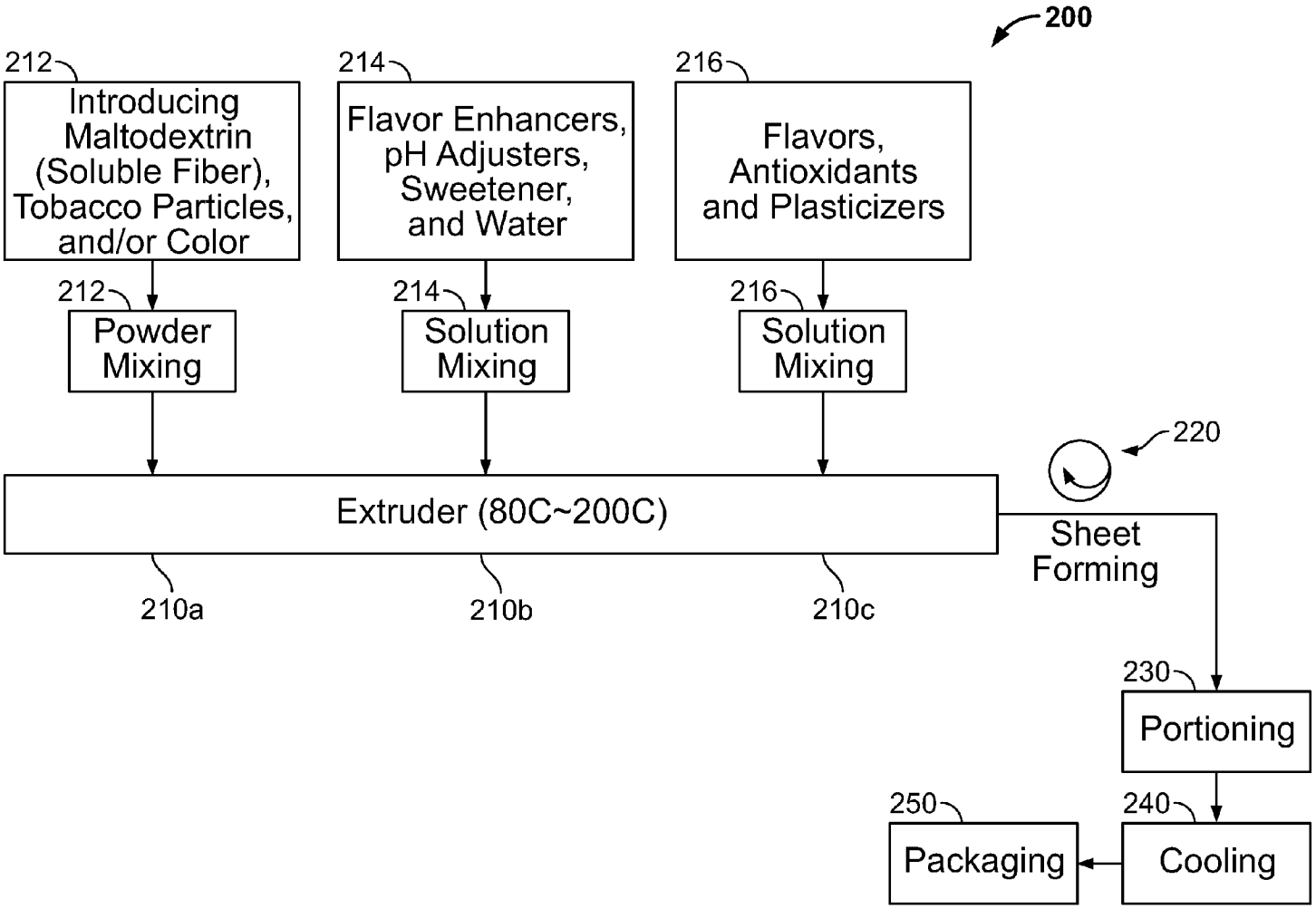
FIG. 2 depicts an exemplary process flow diagram for making exhausted-tobacco lozenges provided herein.

A molten mixture can be mixed and heated in any suitable but controlled method. In some cases, such as shown in FIG. 2, ingredients for a molten mixture can be combined in an extruder and mixed in a continuous extrusion process. Unlike a traditional cooking method for many typical lozenges, an exhausted-tobacco lozenge provided herein can have attributes precisely controlled by extruder operation parameters, such as feed rate, barrel temperature profile, screw design, rpms, etc.

Referring to FIG. 2, an exemplary method 200 for making exhausted-tobacco lozenges provided herein can include adding dry ingredients 212 of soluble fiber (e.g., maltodextrin) and exhausted-tobacco fiber to a first station 210*a* of an extruder 210, adding a first group of solution ingredients 214, including water, at a second station 210*b*, and adding a second group of solution ingredients 216, including nicotine, at a third station 210*c*. A mixing extruder 210 can include multiple stages controlled to be maintained at a predetermined temperature. As shown, extruder 210 can include stages having temperatures ranging between 80° C. and 150° C. For example, dry ingredients 212 and first group of solution ingredients 214 can be mixed in a first stage of extruder 210 at a temperature of between 100° C. and 115° C., one or more subsequent stages can have a higher temperature (e.g., between 115° C. and 150° C.). Second group of solution ingredients 216, including nicotine, can be added downstream of the mixture of water with the soluble fiber. Adding certain ingredients downstream can limit degradation of certain ingredients (e.g., nicotine) due to exposure to heat. A glass transition temperature (Tg) of molten mixture used to make an exhausted-tobacco lozenge provided herein can range from 50° C. to 120° C. (i.e., about 122° F. to about 248° F.).

A water content of an exhausted-tobacco lozenge provided herein can be controlled in the extrusion process to ensure that the molten mixture has a glass transition temperature of greater than human body temperature. In some cases, a molten mixture can have a water content of less than 15 weight percent. In some cases, water content in an exhausted-tobacco lozenge provided herein ranges from 2 weight percent to 15 weight percent. In some cases, water content in an exhausted-tobacco lozenge provided herein ranges from 2 weight percent to 10 weight percent.

After passing through the extruder, a molten mixture provided herein can have a temperature of between its glass transition temperature and 150° C. In some cases, a molten mixture of between 85 and 90 weight percent digestion-resistant maltodextrin can reach a maximum temperature in an extruder of between 80° C. and 110° C. and exit the extruder at that temperature. Because a molten mixture can remain above its glass transition temperature as it exits the extruder, the molten mixture can be reshaped after it exits the extruder. Molten mixture can pass onto a conveyor and move through a sheet forming apparatus 220. Sheet forming apparatus 220 can press the molten mixture into a sheet having a predetermined thickness. For example, a predetermined thickness can be between 1 mm and 25 mm.

Individual exhausted-tobacco lozenges 110 can be cut from a sheet of molten mixture in portioning station 230. In some cases, a stamping die can cut one or more individual exhausted-tobacco lozenges 110 to form a sheet. In some cases, a stamping die can press one or both sides of a sheet to both cut an exhausted-tobacco lozenge and reshape edges to form rounded edges on the exhausted-tobacco lozenges, such as those shown in FIG. 1. Cutting individual exhausted-tobacco lozenges 110 can occur when the molten mixture is still above its Tg. Individual exhausted-tobacco lozenges 110 can be cooled in a cooling station 240 and packaged in a packaging station 250.

In addition to extrusion, there are other methods for mixing and carefully controlling the temperature of a molten mixture used to form exhausted-tobacco lozenges provided herein.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. An exhausted-tobacco lozenge, comprising a body that is wholly receivable in an oral cavity, the body comprising:

a maltodextrin matrix;

exhausted-tobacco fiber dispersed within the maltodextrin matrix; and one or more additives dispersed in the maltodextrin matrix or exhausted-tobacco fiber such that at least one additive is released from the body as the body dissolves when the body is at least partially received within the oral cavity of an adult tobacco consumer and exposed to saliva, wherein the body comprises at least 60 weight percent maltodextrin.

2. The exhausted-tobacco lozenge of claim 1, wherein the body comprises at least 95 weight percent maltodextrin.

3. The exhausted-tobacco lozenge of claim 1, wherein the maltodextrin is amorphous.

4. The exhausted-tobacco lozenge of claim 1, wherein the one or more additives comprises nicotine.

5. The exhausted-tobacco lozenge of claim 4, wherein the nicotine is tobacco-derived nicotine.

6. The exhausted-tobacco lozenge of claim 4, wherein the nicotine is synthetic nicotine.

7. The exhausted-tobacco lozenge of claim 1, wherein the lozenge comprises between 0.5 weight percent and 40 weight percent of exhausted-tobacco fiber.

8. The exhausted-tobacco lozenge of claim 1, wherein the one or more additives is selected from the group consisting of minerals, vitamins, dietary supplements, nutraceuticals, energizing agents, soothing agents, amino acids, chemsthetic agents, antioxidants, botanicals, teeth whitening agents, therapeutic agents, and combinations thereof.

9. The exhausted-tobacco lozenge of claim 1, wherein the one or more additives comprises a flavorant, wherein the flavorant is selected from the group consisting of licorice, wintergreen, cherry and berry type flavorants, Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, coriander, coffee, mint oils from a species of the genus *Mentha*, and combinations thereof.

10. The exhausted-tobacco lozenge of claim 1, wherein the body is shield shaped, wherein the body has a diameter of between 1 mm and 25 mm and a thickness of between 1 mm and 25 mm.

11. The exhausted-tobacco lozenge of claim 1, further comprising a coating on the body.

12. The exhausted-tobacco lozenge of claim 4, wherein the body comprises between 0.1 mg and 20 mg nicotine.

13. The exhausted-tobacco lozenge of claim 1, wherein the body has a glass transition temperature greater than 37° C.

14. The exhausted-tobacco lozenge of claim 1, wherein the body has a glass transition temperature of between 50° C. and 120° C.

15. The exhausted-tobacco lozenge of claim 1, wherein the body is substantially free of sugar alcohols.

16. The exhausted-tobacco lozenge of claim 1, wherein the body comprises between 2 weight percent and 15 weight percent water.

17. The exhausted-tobacco lozenge of claim 1, wherein the body is non-porous.

18. The exhausted-tobacco lozenge of claim 1, wherein the body is brittle.

19. The exhausted-tobacco lozenge of claim 1, wherein the one or more additives comprises a colorant.

20. The exhausted-tobacco lozenge of claim 1, wherein the one or more additives comprises titanium dioxide.

21. The exhausted-tobacco lozenge of claim 1, wherein the one or more additives comprises an antioxidant.

22. The exhausted-tobacco lozenge of claim 1, wherein the one or more additives comprises a sweetener.

23. The exhausted-tobacco lozenge of claim 1, wherein the one or more additives comprises a plasticizer.

24. An exhausted-tobacco lozenge, comprising a body that is wholly receivable in an oral cavity, the body comprising:

an amorphous, soluble-fiber matrix comprising at least 40 weight percent soluble fiber;

exhausted-tobacco fiber dispersed in said matrix; and nicotine or a derivative thereof dispersed in said soluble-fiber matrix such that the nicotine or derivative thereof is released from the body as the body dissolves when the body is at least partially received within the oral cavity of an adult tobacco consumer and exposed to saliva.

25. The exhausted-tobacco lozenge of claim 24, wherein the body comprises one or more soluble fibers selected from the group consisting of maltodextrin, psyllium, inulin, arabinoxylans, cellulose, resistant starch, resistant dextrins, lignin, pectins, beta-glucans, and oligosaccharides, and combinations thereof.

26. The exhausted-tobacco lozenge of claim 24, further comprising a flavorant dispersed in said soluble-fiber matrix such that the flavorant is released from the body as the body dissolves when the exhausted-tobacco lozenge is placed within a mouth of an adult tobacco consumer.

27. The exhausted-tobacco lozenge of claim 24, wherein the body comprises at least 75 weight percent soluble fiber, wherein the body is substantially free of sugar alcohols, wherein the body comprises between 0.1 mg and 20 mg nicotine, and wherein the body has a glass transition temperature of between 50° C. and 120° C.

28. A method of forming exhausted-tobacco lozenges:

forming a molten mixture of soluble fiber, exhausted-tobacco fiber, one or more additives, and water while maintaining a mixture temperature of less than 150° C., the molten mixture including at least 40 weight percent of soluble fiber and less than 15 weight percent water; and portioning the molten mixture into a plurality of exhausted-tobacco lozenges.

29. The method of claim 28, wherein the molten mixture is formed in an extruder, wherein the extruder comprises a plurality of stages, wherein the extruder comprises multiple stages where the maximum temperature in any stage is no more than 150° C., wherein the extruder extrudes the molten mixture at a temperature of greater than the molten mixture's Tg and less than 150° C., wherein the molten mixture comprises at least 40 weight percent maltodextrin, and wherein the one or more additives comprise nicotine.

30. An exhausted-tobacco lozenge, comprising a body that is wholly receivable in an oral cavity, the body comprising:

a maltodextrin matrix;

exhausted-tobacco fiber dispersed within the maltodextrin matrix; and one or more additives dispersed in the maltodextrin matrix or exhausted-tobacco fiber such that at least one additive is released from the body as the body dissolves when the body is at least partially received within the oral cavity of an adult tobacco consumer and exposed to saliva, wherein the body has a glass transition temperature greater than 37° C.

* * * * *